US009487380B2

(12) United States Patent
Hanley

(10) Patent No.: US 9,487,380 B2
(45) Date of Patent: Nov. 8, 2016

(54) HOIST ASSEMBLY

(71) Applicant: Jeff Hanley, Burbank, CA (US)

(72) Inventor: Jeff Hanley, Burbank, CA (US)

( * ) Notice: Subject to any disclaimer, the term of this patent is extended or adjusted under 35 U.S.C. 154(b) by 0 days.

(21) Appl. No.: 14/504,537

(22) Filed: Oct. 2, 2014

(65) Prior Publication Data

US 2016/0096710 A1 Apr. 7, 2016

(51) Int. Cl.

| | |
|---|---|
| ***B66D 1/12*** | (2006.01) |
| ***B66D 1/60*** | (2006.01) |
| *B66C 23/02* | (2006.01) |
| *B66C 23/20* | (2006.01) |

(52) U.S. Cl.

CPC . *B66D 1/12* (2013.01); *B66D 1/60* (2013.01); *B66C 23/022* (2013.01); *B66C 23/203* (2013.01)

(58) Field of Classification Search

CPC ..... B66D 1/12; B66D 1/36; B66D 1/60; B66C 23/022; B66C 23/203; B66C 23/22

USPC ..... 254/332

See application file for complete search history.

(56) References Cited

U.S. PATENT DOCUMENTS

| | | | | | |
|---|---|---|---|---|---|
| 3,666,054 | A * | 5/1972 | Ellings | E06C 7/16 | 182/103 |
| 4,004,778 | A | 1/1977 | Steinhagen | | |
| 4,128,228 | A * | 12/1978 | Ziegelmann | E06C 7/12 | 182/101 |
| D260,754 | S | 9/1981 | Gunnels | | |
| 4,598,795 | A * | 7/1986 | Larson | E06C 7/48 | 182/129 |
| 4,690,248 | A * | 9/1987 | Killeen | E06C 1/39 | 182/118 |
| 5,279,389 | A * | 1/1994 | Crockett | E06C 7/48 | 182/129 |
| 5,427,356 | A * | 6/1995 | Krotov | B66C 19/02 | 182/129 |
| 5,911,287 | A | 6/1999 | Campbell | | |
| 6,244,381 | B1 | 6/2001 | Ruble | | |
| 6,454,049 | B1 * | 9/2002 | Dorsett | E06C 7/12 | 182/102 |
| 6,926,241 | B2 * | 8/2005 | Garrett | B23D 45/003 | 182/107 |
| 7,424,932 | B1 * | 9/2008 | Murphy | E06C 1/345 | 182/103 |
| 7,546,902 | B2 * | 6/2009 | Schwertner | B66B 9/193 | 182/103 |
| 7,942,243 | B1 | 5/2011 | Blehm | | |
| 2005/0173190 | A1 * | 8/2005 | Garrett | B23D 45/003 | 182/45 |
| 2009/0057057 | A1 * | 3/2009 | Sracic | E06C 7/12 | 182/141 |
| 2015/0273250 | A1 * | 10/2015 | Bina | A62B 99/00 | 182/8 |
| 2015/0300090 | A1 * | 10/2015 | Strand | E06C 1/38 | 182/103 |

* cited by examiner

*Primary Examiner* — Sang Kim
*Assistant Examiner* — Nathaniel Adams

(57) ABSTRACT

A hoist assembly includes a mount. A plurality of hooks is coupled to the mount. The plurality of hooks engages a ladder. The mount may be coupled to the ladder. A plate is provided. The plate engages the mount. The plate may be positioned above a roof access hatch. A winch is coupled to the plate. A cable is wrapped around the winch. The winch may extend or retract the cable. A hook is coupled to the cable. The hook engages an object. The assembly may lift the object upwardly through the roof access hatch.

1 Claim, 5 Drawing Sheets

HOIST ASSEMBLY

BACKGROUND OF THE DISCLOSURE

Field of the Disclosure

The disclosure relates to hoist devices and more particularly pertains to a new hoist device for lifting a heavy object onto a roof.

SUMMARY OF THE DISCLOSURE

An embodiment of the disclosure meets the needs presented above by generally comprising a mount. A plurality of hooks is coupled to the mount. The plurality of hooks engages a ladder. The mount may be coupled to the ladder. A plate is provided. The plate engages the mount. The plate may be positioned above a roof access hatch. A winch is coupled to the plate. A cable is wrapped around the winch. The winch may extend or retract the cable. A hook is coupled to the cable. The hook engages an object. The assembly may lift the object upwardly through the roof access hatch.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
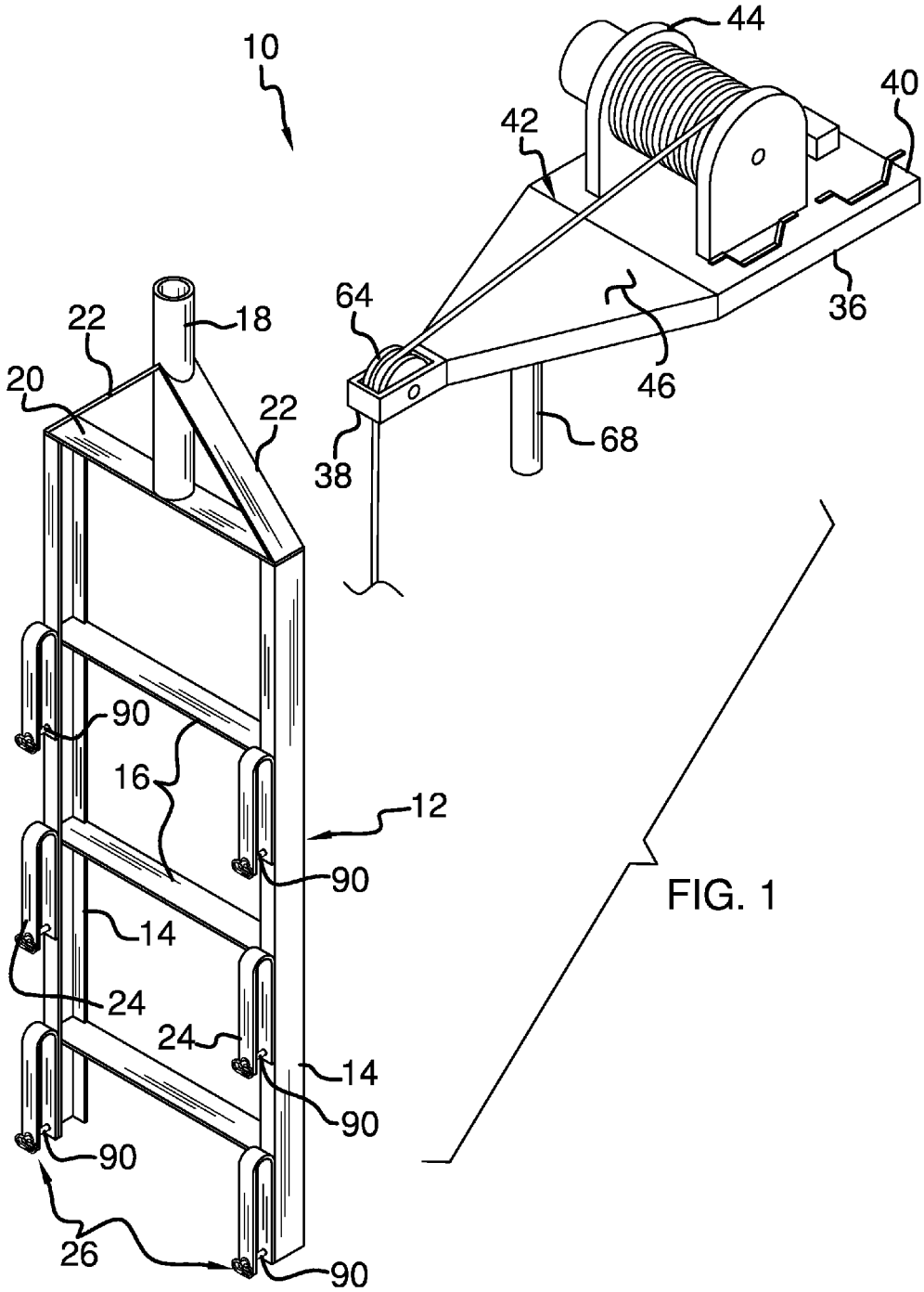
FIG. 1 is a top perspective view of a hoist assembly according to an embodiment of the disclosure.
Figure 2:
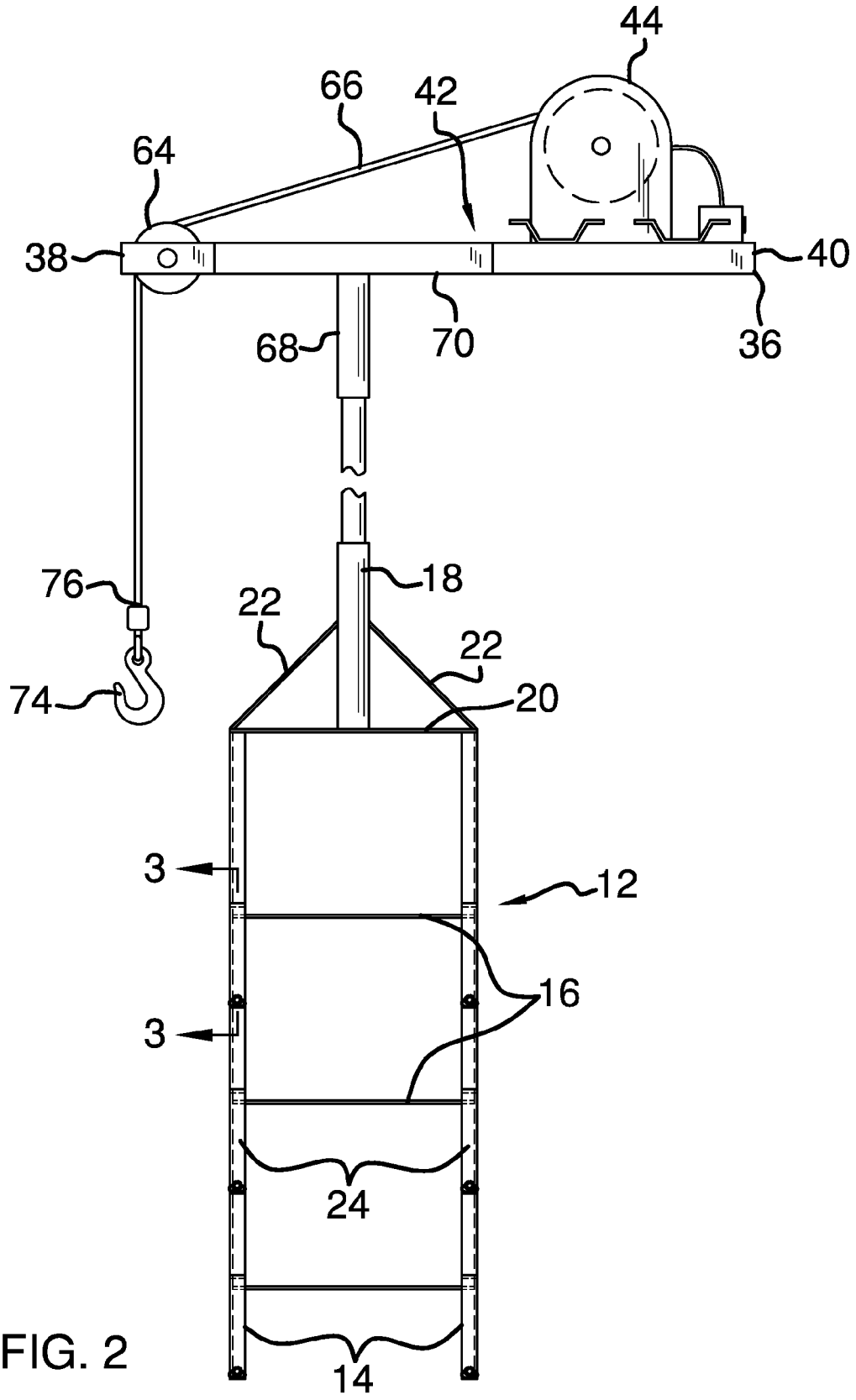
FIG. 2 is a front view of an embodiment of the disclosure.
Figure 4:
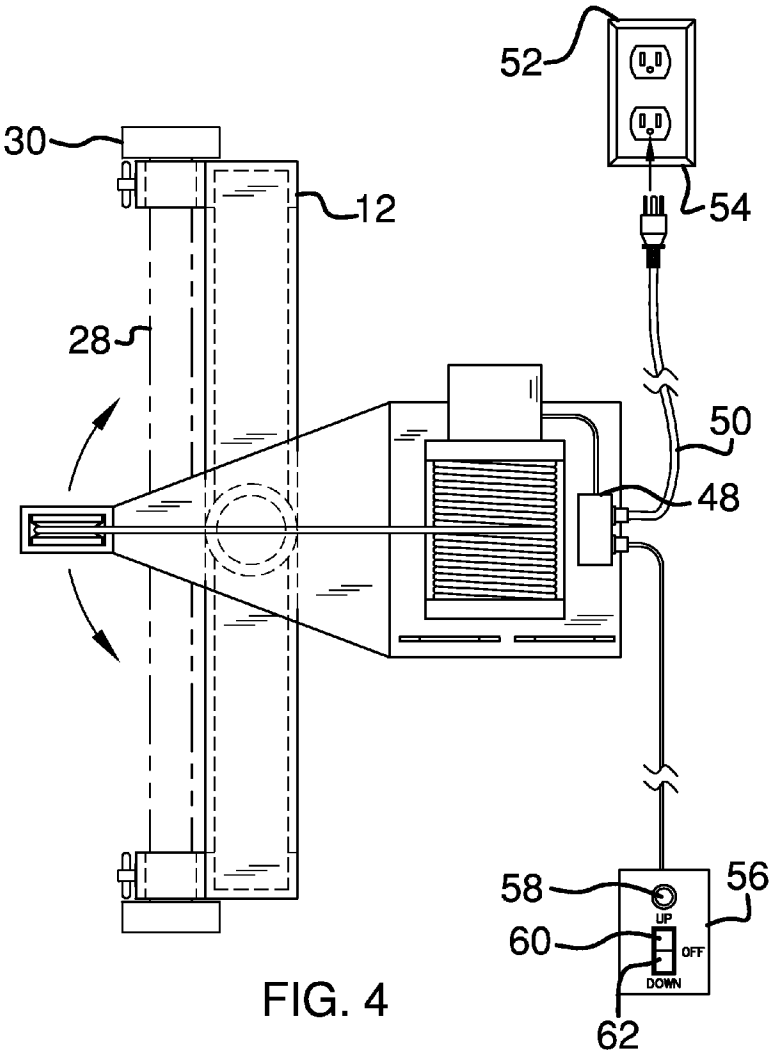
FIG. 4 is a top view of an embodiment of the disclosure.

With reference now to the drawings, and in particular to FIGS. 1 through 6 thereof, a new hoist device embodying the principles and concepts of an embodiment of the disclosure and generally designated by the reference numeral 10 will be described.

As best illustrated in FIGS. 1 through 6, the hoist assembly 10 generally comprises a mount 12. The mount 12 comprises a pair of longitudinal arms 14 of the mount 12. The longitudinal arms 14 of the mount 12 are spaced apart. The mount 12 further comprises a plurality of lateral arms 16 of the mount 12 each coupled to and extending between the pair of longitudinal arms 14 of the mount 12. Moreover, the lateral arms 16 of the mount 12 are evenly spaced apart and distributed along an entire length of the longitudinal arms 14 of the mount 12.

A sleeve 18 is coupled to and extends upwardly from a top one 20 of the lateral arms 16 of the mount 12. A pair of supports 22 is provided. The pair of supports 22 extends between the sleeve 18 and the top lateral arm 20 of the mount 12. Additionally, the pair of supports 22 extends at an angle between opposite sides of sleeve 18 and the top lateral arm 20 of the mount 12.

A plurality of hooks 24 is provided. The plurality of hooks 24 are bent so the hooks 24 each has a U-shape. The plurality of hooks 24 comprise a pair of sets 26 of the hooks 24. Additionally, the pair of sets 26 of the hooks 24 is each coupled to an associated one of the pair of longitudinal arms 14 of the mount 12. The sets 26 of hooks 24 are evenly spaced apart and distributed along an entire length of the associated longitudinal arms 14 of the mount 12.

Figure 3:
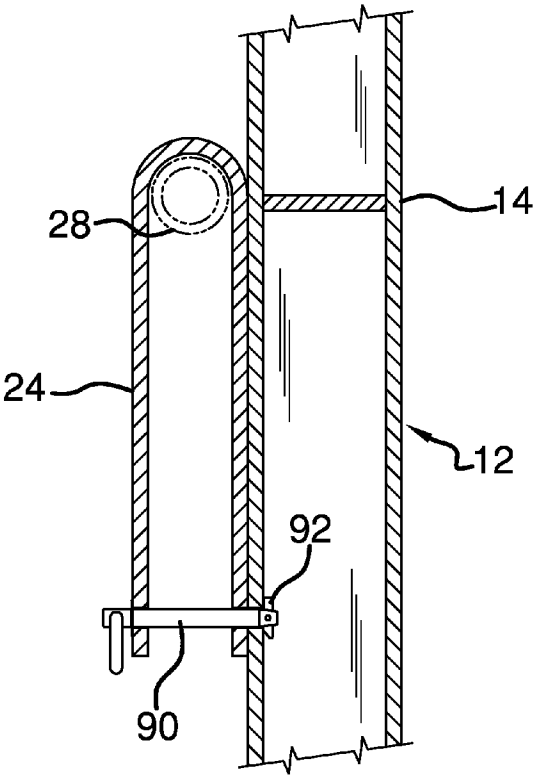
FIG. 3 is a cross sectional view taken along line 3-3 of FIG. 2 of an embodiment of the disclosure.
Figure 5:
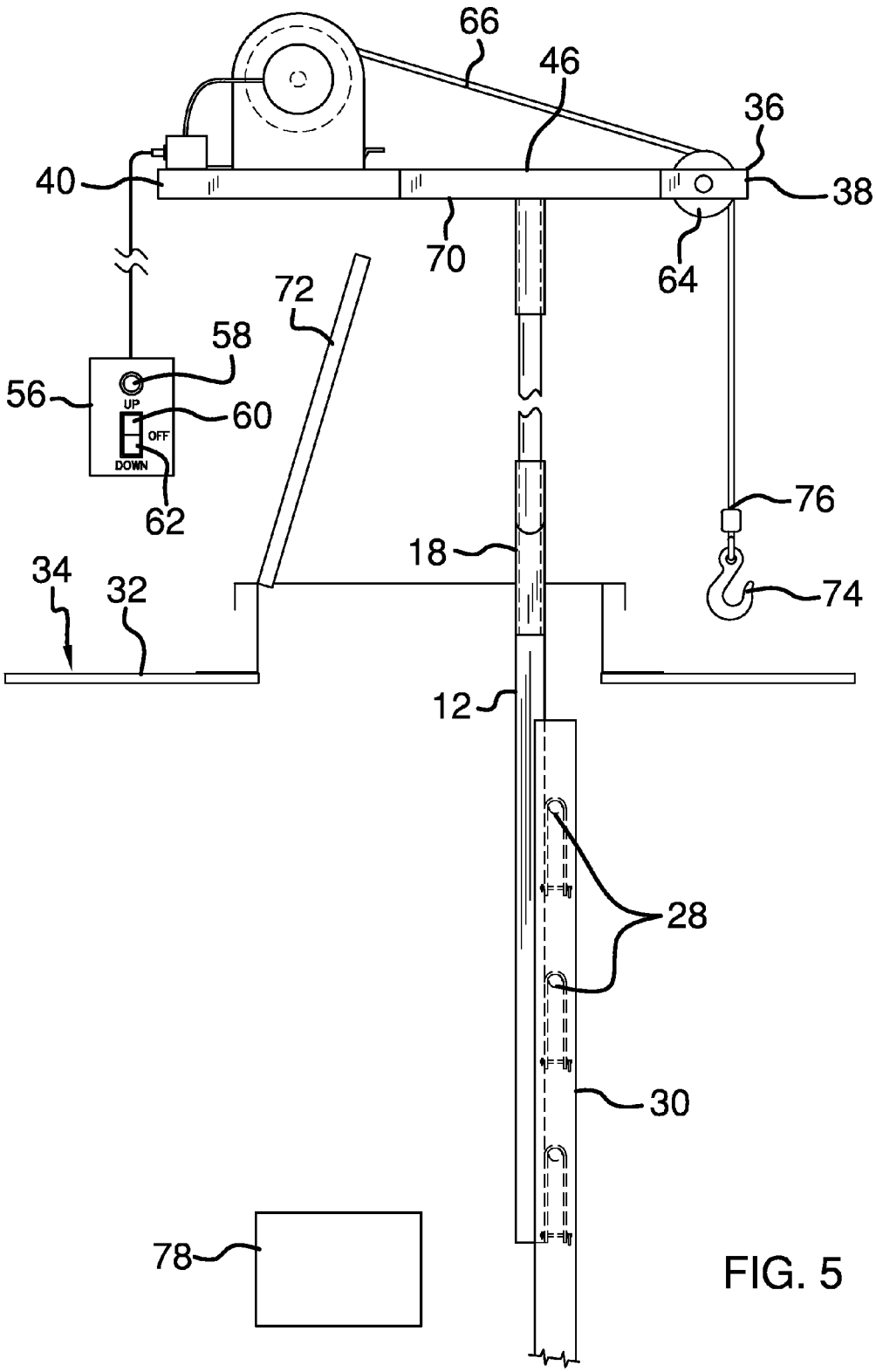
FIG. 5 is a right side view of an embodiment of the disclosure.
Figure 6:
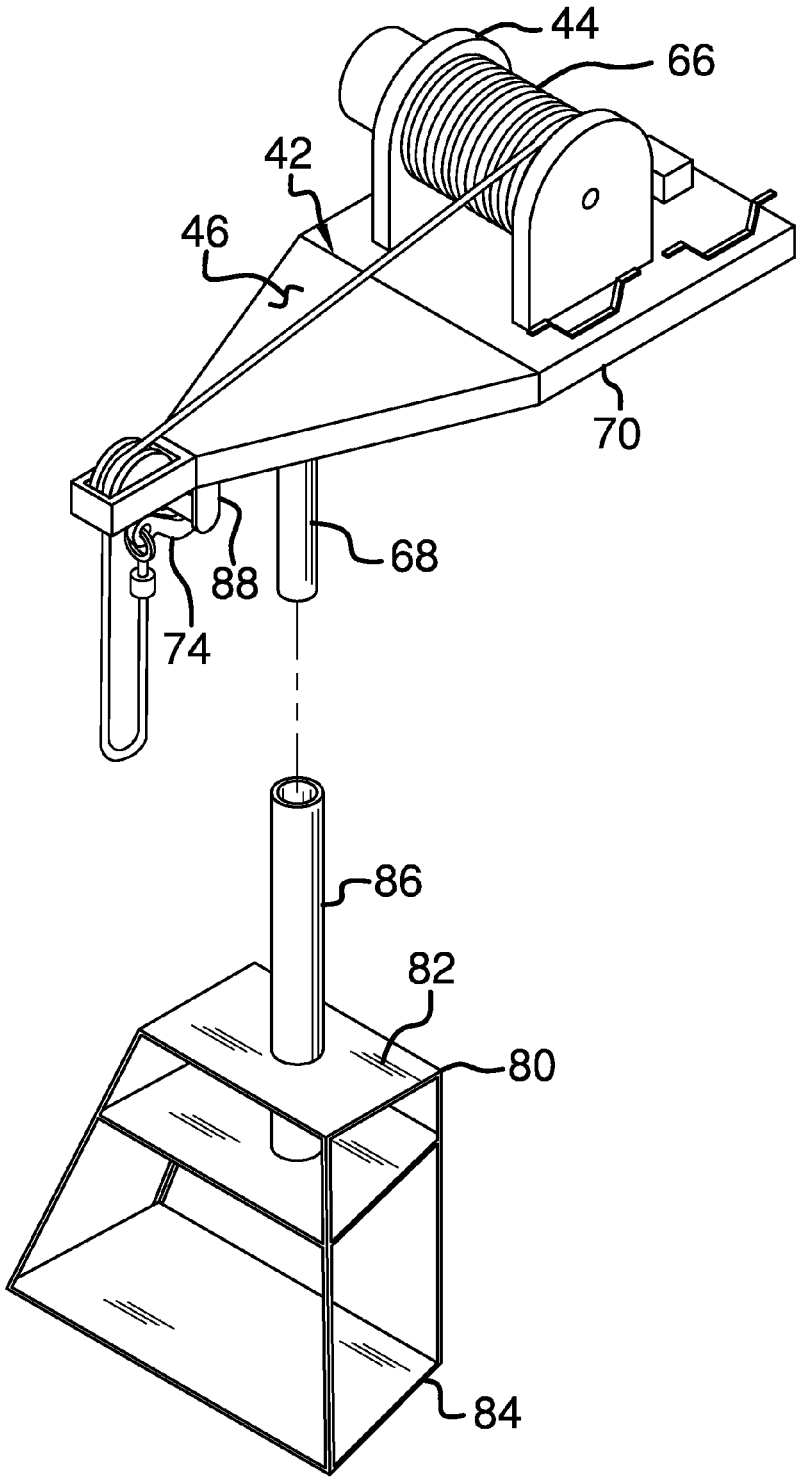
FIG. 6 is a right side view of an embodiment of the disclosure.

Each of the set 26 of hooks 24 removably engages an associated one of a plurality of rungs 28 on a ladder 30 coupling the mount 12 to the ladder 30. The ladder 30 may be a roof access ladder of any conventional design providing access to a roof 32 of a building 34. Each of a plurality of retaining pins 90 may be inserted through an associated one of the hooks 24 and into the mount 12 to prevent the associated hook 24 from disengaging from the rung 28 of the ladder 30. Each retaining pin 90 may have a pivotal foot 92 to facilitate retention of the retaining pin 90 by engaging the mount 12 to inhibit removal of the retaining pin 90 from the mount 12 as shown in FIG. 3.

A plate 36 is provided. The plate 36 has a first end 38 and a second end 40. Additionally, the plate 36 is elongated. The plate 36 tapers between a middle 42 of the plate 36 and the first end 38 of the plate 36.

A winch 44 is coupled to a top surface 46 of the plate 36. The winch 44 is positioned proximate the second end 40 of the plate 36. The winch 44 may be an electrically operated winch of any conventional design.

A power supply 48 is electrically coupled to the winch 44. The power supply 48 comprises a power cord 50 extending away from the winch 44. The power cord 50 is electrically coupled to a power source 52. The power source 52 may be an electrical outlet 54 of any conventional design.

A control 56 is provided. The control 56 is electrically coupled to the winch 44. A power actuator 58 is coupled to the control 56. The power actuator 58 actuates and de-actuates the power supply 48. An up actuator 60 is coupled to the control 56. The up actuator 60 is actuatable so the winch 44 spins in a retracting direction. A down actuator 62 is coupled to the control 56. The down actuator 62 is actuatable so the winch 44 spins in an extending direction.

A pulley 64 is rotatably coupled to the first end 38 of the plate 36. A cable 66 is provided. The cable 66 is wrapped around the winch 44. Moreover, the winch 44 may extend or retract the cable 66 when an associated one of the up 60 and down 62 actuators are actuated. The cable 66 rotatably engages the pulley 64 so the cable 66 extends downwardly from the pulley 64.

A rod 68 is coupled to a bottom surface 70 of the plate 36. The rod 68 is positioned closer to the first end 38 of the plate 36 than the second end 40 of the plate 36. The rod 68 rotatably engages the sleeve 18 so the plate 36 is spaced upwardly from the mount 12. The first end 38 of the plate 36 extends laterally away from the mount 12. Moreover, the first end 38 of the plate 36 is aligned with a roof access hatch 72. The roof access hatch 72 may extend through the roof 32 on the building 34.

A hook 74 is coupled to a free end 76 of the cable 66. The hook 74 may engage an object 78. The assembly 10 may lift or lower the object 78 upwardly or downwardly through the roof access hatch 72.

Alternatively, a frame 80 is provided. The frame 80 has a top end 82 and a bottom end 84. Additionally, the frame 80 is elongated between the top 82 and bottom 84 ends. The bottom end 84 of the frame 80 may abut the roof 32.

A sleeve 86 is coupled to and extends upwardly form the top end 82 of the frame 80. The rod 68 rotatably engages the sleeve 86 so the plate 36 is spaced upwardly from the frame 80. The frame 80 is positionable proximate the roof access hatch 72. The frame 80 may be utilized if the ladder 30 is not available.

Continuing in the alternative embodiment, a retainer 88 is coupled to the bottom surface 70 of the plate 36. The retainer 88 is positioned proximate the first end 38 of the plate 36. The hook 74 on the cable 66 selectively engages the retainer 88 so the hook 74 may be stored.

In use, the assembly 10 is utilized when the object 78 is to be lifted onto the roof 32 of the building 34. The assembly 10 lifts the object 78 if the object 78 is too heavy to be lifted by an individual. The down actuator 62 is actuated so the cable 66 is extended downwardly through the roof access hatch 72. The hook 74 on the cable 66 is coupled to the object 78. The up actuator 60 is actuated so the object 78 is lifted upwardly through the roof access hatch 72. The plate 66 is rotated so the object 78 may be lowered onto the roof 32.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A hoist assembly comprising:

a mount, said mount having opposed parallel planar faces, said mount comprising a pair of longitudinal arms of said mount, said longitudinal arms of said mount being spaced apart, said mount further comprising a plurality of lateral arms of said mount each coupled to and extending between said pair of longitudinal arms of said mount, said lateral arms of said mount being evenly spaced apart and distributed along an entire length of said longitudinal arms of said mount;

a plurality of hooks, said plurality of hooks being bent such that said hooks each has a U-shape;

said plurality of hooks comprising a pair of sets of said hooks, said pair of sets of said hooks each being coupled to an associated one of said pair of longitudinal arms of said mount, said sets of hooks being evenly spaced apart and distributed along an entire length of said associated longitudinal arms of said mount;

each of said set of hooks being configured for removably engaging an associated one of a plurality of rungs on a ladder such that said mount is configured to be coupled to the ladder adjacent and parallel to the ladder;

a plurality of retaining pins, each said retaining pin being insertable through an associated one of said hooks and said mount to prevent said associated hook from disengaging from the ladder;

a plate having a first end and a second end, said plate being elongated;

a winch coupled to a top surface of said plate such that said winch is positioned proximate said second end of said plate;

a pulley rotatably coupled to said first end of said plate;

a cable wrapped around said winch such that said winch is configured to extend or retract said cable, said cable engaging said pulley such that said cable extends downwardly from said pulley;

a rod coupled to a bottom surface of said plate such that said rod is positioned closer to said first end of said plate than said second end of said plate, said rod rotatably engaging said mount such that said plate is perpendicular to and spaced upwardly from said mount, said first end of said plate extending laterally away from said mount such that said first end of said plate is positioned above and aligned with a roof access hatch;

a hook coupled to said cable, said hook engaging an object such that said assembly is configured to lift the object upwardly through the roof access hatch; and a power supply electrically coupled to said winch, said power supply comprising a power cord extending away from said winch, said power cord being electrically coupled to a power source.

* * * * *